US005155532A

United States Patent [19]

Sakurada et al.

[11] Patent Number: 5,155,532

[45] Date of Patent: Oct. 13, 1992

[54] METHOD FOR DEVELOPING AN ELECTROSTATIC LATENT IMAGE

[75] Inventors: Masahisa Sakurada; Sachiko Yasuda, both of Tokyo; Shinya Tomura, Yamato, all of Japan

[73] Assignee: Kabushiki Kaisha Toshiba, Kawasaki, Japan

[21] Appl. No.: 617,951

[22] Filed: Nov. 27, 1990

Related U.S. Application Data

[63] Continuation of Ser. No. 192,086, May 10, 1988, abandoned.

[30] Foreign Application Priority Data

May 11, 1987 [JP] Japan ..... 62-114005

[51] Int. Cl.[5] ..... G03G 15/08; G03G 13/08

[52] U.S. Cl. ..... 355/245; 118/653; 355/259; 430/111; 430/120; 430/903

[58] Field of Search ..... 355/245, 259; 118/649, 118/653; 430/97, 109, 111, 120, 903

[56] References Cited

U.S. PATENT DOCUMENTS

| | | | |
|---|---|---|---|
| 3,731,146 | 5/1973 | Bettiga et al. | 118/637 X |
| 3,965,022 | 6/1976 | Strong et al. | 430/903 X |
| 3,969,251 | 7/1976 | Jones et al. | 430/106 |
| 4,259,426 | 3/1981 | Hasegawa et al. | 430/903 X |
| 4,284,701 | 8/1981 | Abbott et al. | 430/111 |
| 4,329,415 | 5/1982 | Ikeda et al. | 430/903 X |
| 4,342,822 | 8/1982 | Hosono et al. | 430/97 |
| 4,415,645 | 11/1983 | Kouchi et al. | 430/903 X |
| 4,444,864 | 4/1984 | Takahashi | 430/120 |
| 4,498,756 | 2/1985 | Hosoya et al. | 355/3 DD |
| 4,521,098 | 6/1985 | Hosoya et al. | 355/3 DD |
| 4,548,489 | 10/1985 | Yoshikawa | 355/253 |
| 4,628,860 | 12/1986 | Hosoya et al. | 118/649 |
| 4,656,965 | 4/1987 | Hosoya et al. | 118/649 |
| 4,806,992 | 2/1989 | Yasuda et al. | 355/259 |

FOREIGN PATENT DOCUMENTS

| | | | |
|---|---|---|---|
| 0164262 | 12/1985 | . | |
| 0238130 | 9/1987 | . | |
| 2522771 | 12/1975 | Fed. Rep. of Germany . | |
| 60-53975 | 3/1985 | Japan | 355/259 |
| 61-1667553 | 12/1986 | Japan . | |
| 2163371 | 2/1986 | United Kingdom . | |

OTHER PUBLICATIONS

Masahumi Arakawa, Masumi Koishi, Mitsuo Kakuta, Manabu Takeuchi, Seishirou Itou, "Material Design of New Particles", Jun. 10, 1988, pp. 103-107 and 131, Pub. by Techno System Corp., Japan.

IEEE-IAS -1985 Annual Meeting "Xerographic Development Using Single Component Non-Magnetic Toner" P1485-1490 -M Hosoya et al; 1985.

Mahabadi, H. et al., "Combined Polymerization -Toner Manufacturing Process", Xerox Disclosure Journal, Mar./Apr. 1984, p. 165, vol. 9, No.2.

*Primary Examiner*—Fred L. Braun

*Attorney, Agent, or Firm*—Cushman, Darby & Cushman

[57] ABSTRACT

A method for developing electrostatic latent image on the surface of a photosensitive drum using one-component developer. The developer has an average particle diameter of 7-15 μm. Particles of up to 5 μm diameter constitutes at most 25% in the particle number distribution. Particles of no less than 20 μm diameter constitute at most 5% in the particle size volume distribution. The developer particles can be sufficiently triboelectrically charged so as to prevent fogging of developed images and to obtain developer images of good quality.

5 Claims, 2 Drawing Sheets

METHOD FOR DEVELOPING AN ELECTROSTATIC LATENT IMAGE

This is a continuation of application Ser. No. 07/192,086 now abandoned, filed on May 10, 1988.

BACKGROUND OF THE INVENTION

1. Field of the Invention

The present invention relates to a method for developing an electrostatic latent image formed on the surface of a photosensitive body (for example, the photosensitive drum of the general type used in photocopy machines, laser printers, etc.) with one-component developers.

2. Description of the Prior Art

It is known to use one-component developers and two-component developers for developing latent electrostatic images.

A two-component developer includes toner particles which actually form a visible image from the latent image and carrier particles for properly charging the toner. In such two-component developers, a mixing ratio of toner to carrier, i.e., a toner concentration, must be kept constant. However, it is difficult to maintain toner concentration constant. One-component developer has an advantage in that concentration control is not necessary since toner is the only component of the developer.

One-component developers are generally classified into two distinct types, namely magnetic and non-magnetic developers. Magnetic developers use magnetic materials together with non-magnetic materials as the developer particles. When such a magnetic developer is used in a conventional apparatus, a magnet is positioned inside a developer carrier for carrying developer to the developing position and generating a magnetic field for supporting and carrying the developer. However, the following problems exist in using magnetic developer.

First, the developer carrier must be a fairly complicated structure that is large in size. It is expensive to produce because the magnet must be supported by the developer carrier. Second a magnetic developer containing magnetic particles is more expensive than a non-magnetic developer. Finally, since the magnetic particles do not contribute to development, color reproducibility is not satisfactory. As a result, it is difficult to perform color development using a magnetic developer.

In an effort to overcome these problems, a developing apparatus using a non-magnetic one-component developer was developed, as disclosed in U.S. Pat. No. 4,521,098 to Hosoya et al. In Hosoya et al, a thin film layer of a non-magnetic toner is formed on a developing roller. It is pressed by only one blade, and the toner is triboelectrically charged by the blade. Thereafter, the toner is supplied to a photosensitive body on which a latent image is formed.

The concept of using a one-component developer having toner particles of an average particle diameter of 5–30 μm is disclosed by U.S. Pat. No. 4,342,822. However, the developing method disclosed in that patent does not specify an appropriate average particle diameter. Average particle diameter is significant with respect to the quality of development. When the toner particles have an average particle diameter that is too large, images are not developed with a high resolution. Further, when the toner particles have an average particle diameter that is too large, it is not sufficiently charged. When the toner particles have an average particle diameter that is too small, the toner does not flow well through the system in which it is used.

With the conventional developing apparatus, because toner is triboelectrically charged on only one blade, all the toner particles cannot be sufficiently and reliably charged. When the toner is insufficiently charged, fogging or scattering of toner particles occurs, and a clear image cannot be obtained. When a toner image is successively transferred onto sheets, transferred images become blurred due to insufficient charging of toner.

Other background information is disclosed in the following documents: "XEROGRAPHIC DEVELOPMENT USING SINGLE-COMPONENT NON-MAGNETIC TONER" by Masahiro Hosoya, Shinya Tomura, and Tsutomu Uehara of the Toshiba R & D Center; published by the IEEE in 1985; U.S. Pat. No. 3,731,146 — Bettiga et al (May 1, 1973), U.S. Pat. No. 4,498,756 — Hosoya et al (Feb. 12, 1985), U.S. Pat. No. 4,656,965 — Hosoya et al (Apr. 14, 1987), and U.S. Pat. No. 4,628,860 — Hosoya et al (Dec. 16, 1986). The disclosures of the U.S. patent references are hereby incorporated by reference as if their disclosures were fully set forth herein.

SUMMARY OF THE INVENTION

Accordingly it is an object of the present invention to provide a developing method which overcomes the aforementioned problems. More specifically, it is an object of the invention to provide a developing method that overcomes the fogging problem, while at the same time providing sufficiently dense images with high resolution.

It is a further object of the present invention to provide a developing method for electrostatic photocopies in which there can be formed a uniformly thin layer of developer on a developing roller for sufficiently developing a latent image.

In accordance with the present invention, the foregoing objects, among others, are achieved by providing a method for developing electrostatic latent image comprising the steps of:

forming an electrostatic latent image on the surface of an image holding member; and supplying one-component developer particles to the electrostatic latent image, the one-component developer particles having being sized such that:

the average particle diameter is 7–15 μm, particles having a diameter of up to 5 μm constitute at most 25% of the number of particles of developer, and particles of at least 20 μm in diameter constitute no more than 5% of the volume of the developer.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

A more complete appreciation of the present invention and many of its attendant advantages will be readily obtained by reference to the following detailed description considered in connection with the accompanying drawings, in which.

DETAILED DESCRIPTION OF THE PREFERRED EMBODIMENTS

Figure 1:
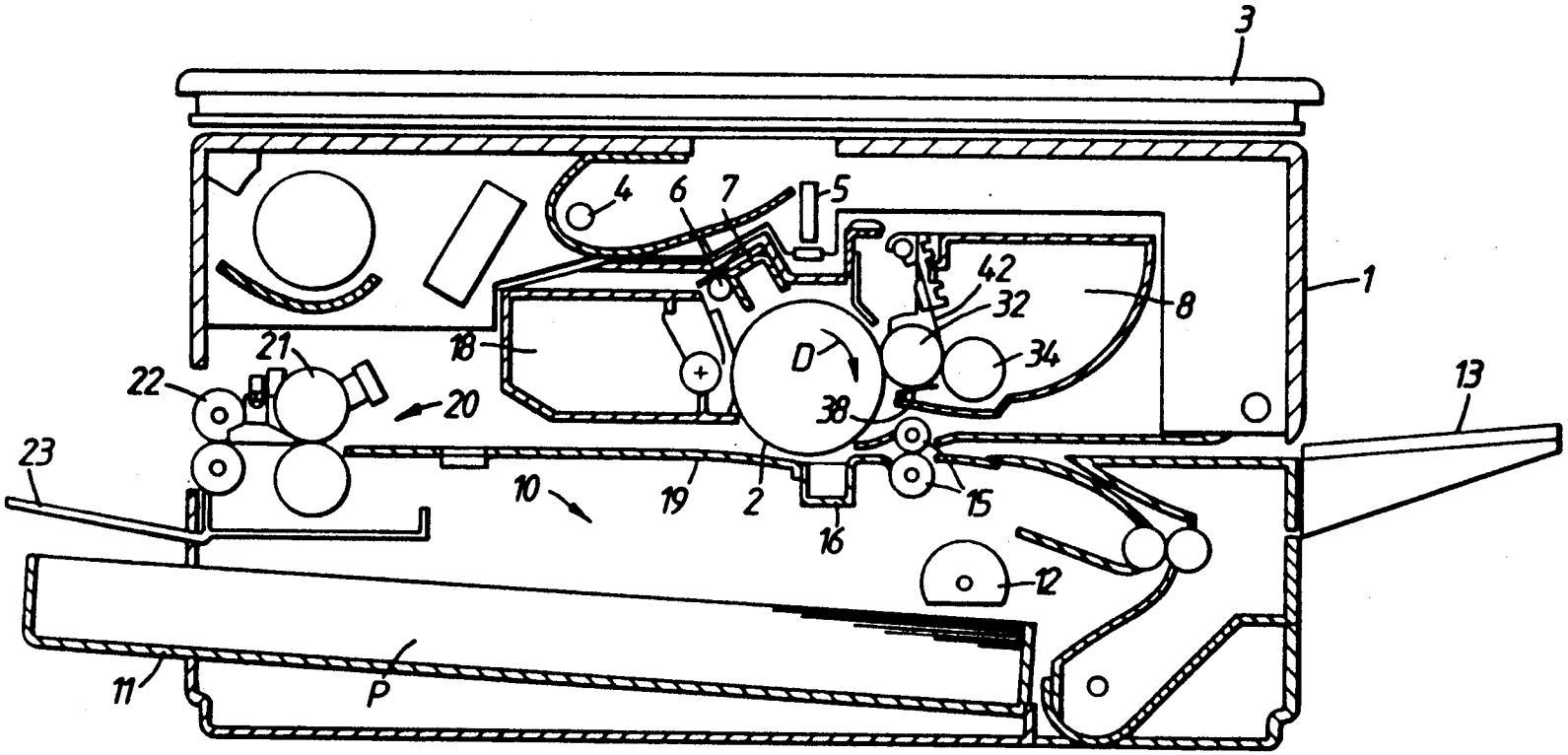
FIG. 1 is a schematic sectional view of copying machine in which the developing method according to the present invention can be used.
Figure 2:
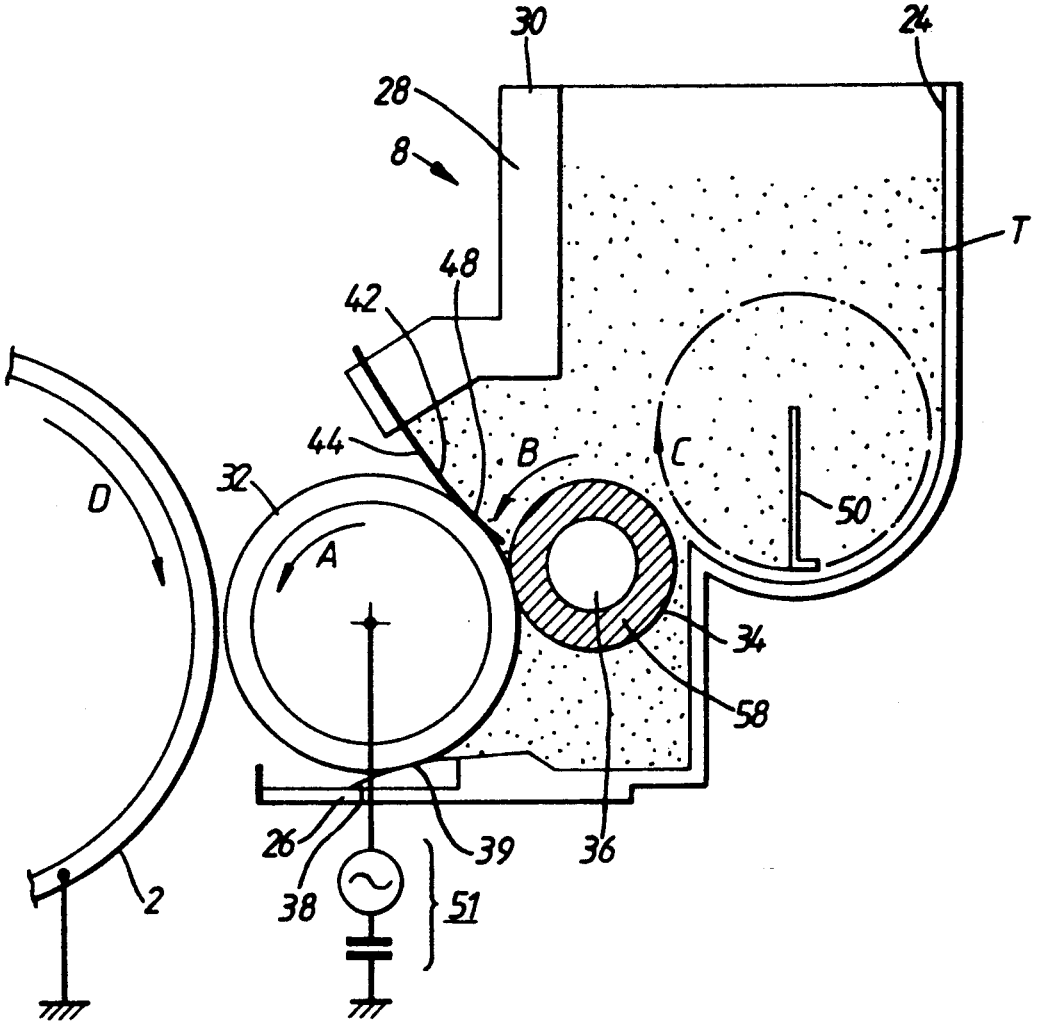
FIG. 2 is a schematic sectional view of the developing apparatus shown in FIG. 1.

FIG. 1 is a schematic sectional view of a copying machine in which the developing method according to the present invention can be used. It is schematically illustrated in FIG. 2. Of course, it should be kept in mind that the invention is not limited to use in a copying machine. The description of a copy machine, however, is convenient for the purposes of illustration. A photosensitive drum 2, having a photosensitive film such as a selenium film thereon, is rotatably arranged at substantially the center of a housing 1. An electrostatic latent image is formed on the surface of photosensitive drum 2 which acts as an image carrier. A lamp 4 and converging optical transmission member 5, optically scan a document placed on reciprocally driven document table 3, and focus an image of the document onto a surface portion of photosensitive drum 2 to form a latent image thereon. Arranged around photosensitive drum 2 are a discharge lamp 6 for discharging the surface of photosensitive drum 2 before the document image is focused thereon, a charger 7 for uniformly charging the surface of photosensitive drum 2 after the surface of photosensitive drum 2 is uniformly discharged, and a developing apparatus 8 for selectively applying the developer to the latent image formed on the surface of the photosensitive drum and for visualizing the latent image. A visible image is formed by developing apparatus 8 on photosensitive drum 2.

A paper feeding section is arranged at both sides of housing 1. The paper feeding section comprises paper cassette 11 detachably mounted at one side of the copying machine, and paper feeding rollers 12, brought into rolling contact with an uppermost sheet P so as to feed sheet P to the inside of housing 1. Manual feeding guide 13, for manually guiding a sheet, is arranged at the other side of the copying machine. The sheet fed from the paper feeding section is registered by register rollers 15 and is fed to a transfer portion of photosensitive drum 2 while one sheet is brought into slidable contact with the transfer portion.

A transfer charger 16 which transfers the visible (toner) image onto sheet P is arranged around photosensitive drum 2. The transfer portion described above is defined between photosensitive drum 2 and transfer charger 16. The sheet having the toner image (visible image) thereon is guided by conveyer belt 19 to fixing unit 20. The developer on the sheet is fixed by pressure and heated by a pair of heat rollers 21 constituting a fixing unit 20. The sheet having the fixed image is discharged by a pair of discharge rollers 22 onto a tray 23. The residual toner remaining on the surface of photosensitive drum 2 after the transfer operation can be removed by a cleaning unit 18.

To form an image, the surface potential of photosensitive drum 2 is made to be about − 600 V, a gap between photosensitive drum 2 and developing roller 32 is set to about 250 μm, and a developing bias is established as a superimposed AC voltage of P—P of 2.0 KV at a frequency of about 3 KHz. and a DC voltage of about 200 V provided by a power source 51.

Developing apparatus 8 will now be described with reference to FIG. 2. Developing apparatus 8 comprises housing 30 constituted by a back frame 24, bottom frame 26, and front frame 28. Housing 30 stores non-magnetic developer T. In housing 30, developing roller 32 conveys developer from housing 30 toward photosensitive drum 2 on which a latent image is formed. Developing roller 32 is interposed between bottom frame 26 and front frame 28. Developing roller 32 is arranged adjacent to photosensitive drum 2, and is rotatable in a direction indicated by arrow A in FIG. 2. Therefore, a portion of developing roller 32 is located inside housing 30 to be in contact with developer T, and the other portion on the side of drum 2 is exposed to the outside between bottom frame 26 and front frame 28.

Developing roller 32 has an aluminum sleeve. The outer surface of the sleeve is sand blasted, and has a nickel layer electroplated thereon. A surface roughness of the aluminum sleeve after plating is about 1 μm.

Developer supply roller 34 for supplying developer T to developing roller 32 while charging developer T is arranged adjacent to bottom frame 26 in housing 30. Roller 34 is rotatable in a direction indicated by arrow B in FIG. 2 and is in contact with roller 32.

Developer supplying roller 34 is constituted by a metal shaft 36 having conductive rubber 58 coated thereon. Conductive rubber material 58 can be prepared by mixing carbon or metal powder in neoprene rubber.

The proximal end portion 44 of an elastic blade 42 forms a thin film layer of developer on developing roller 32 and charges it. Blade 42 is mounted on the lower end portion 40 of front frame 28. The free end portion 48 of elastic blade 42 is urged against developing roller 32 at a position above a contacting point between rollers 34 and 32.

The elastic blade 42 is pressed toward developing roller 32 on 20 to 500 g/cm. A surface of elastic blade is painted particles. This particle's melting point is at least 80° C. and average particle diameter of 50% is at most 10 μm.

Stirring plate 50 for stirring the developer inside housing 30 is rotatable in a direction indicated by arrow C in FIG. 2 and arranged at substantially the center of housing 30.

The superimposed voltage power source 51 is connected to developing roller 32. A base of photosensitive drum 2 is grounded.

Developer supplying roller 34 is rotated in a direction opposite to arrow A at a contacting point with developing roller 32. Roller 34 moves toner therearound by a frictional force with its outer peripheral surface, so as to triboelectrically charge the developer particles. In this particular embodiment, the developer is charged to be positive (+). Roller 34 is grounded, and so has a relatively negative (−) charge. Therefore, the developer becomes attached to roller 34 by an electrostatic force, and is moved upon rotation of roller 34. Since the attached developer particles are moved with the roller 34 upon rotation of roller 34, developer particles can be sufficiently triboelectrically charged together with the surrounding developer particles.

The developer particles, which become attached to roller 34 and are sufficiently charged, are rubbed onto roller 32 at the contacting point between rollers 34 and 32. Upon this rubbing, the developer becomes attached to roller 32. The toner attached to roller 32 is pressed by blade 42 and is further triboelectrically charged, thus forming a uniform thin layer.

Roller 32 is rotated in the direction indicated by arrow A and conveys the developer layer to a position facing photosensitive drum 2. A developing bias is established between roller 32 and drum 2 by power source 51, so that the developer particles attached to roller 32 fly to drum 2, thus developing a latent image formed thereon.

Residual developer which is not subjected to development remains on the outer peripheral surface of roller 32. However, the residual developer is further conveyed upon rotation of roller 32, and is recovered in housing 30 by recovering blade 38 without fogging or scattering. As the residual developer passes over recovering blade 38 into housing 30, the residual developer is rubbed by second layer 39 of recovering blade 38 during rotation of developing roller 32. Since second layer 39 of recovering blade 38 is made of a conductive material, the residual toner is not nonuniformly or abnormally charged by the friction therebetween. Therefore, the residual developer is uniformly attached to developing roller 32 by a triboelectrical charge and is further conveyed toward developer supplying roller 34 upon further rotation of developing roller 32. Developing roller 32 is then supplied with new, sufficiently charged, developer by developer supplying roller 34 and is further rotated to develop a latent image formed on photosensitive drum 2 as described above.

The developer particles are sized to meet the following conditions: 1) the average particle diameter is 7–15 μm, 2) developer particles of up to 5 μm in particle diameter contained in the developer occupy at most 25% in the particle number distribution, and 3) developer particles of no less than 20 μm in particles diameter contained in the developer occupy at most 5% in the particle size volume distribution.

The developer contains 0.05–5 parts of one of inorganic oxide, inorganic salt and organic particles. That one particle has an average particle diameter of up to 20 μm wherein the particles of no less than 10 μm in particle diameter contained in the particles occupy at most 20% in the particle size volume distribution.

One reason that developed images may be fogged relates to the triboelectric charging that occurs between developer T and elastic blade 42, and between developer T and developing roller 32. In this case, developer particles which do not have the opposite charge to image portions of drum 2 are attached to non-image portions of drum 2.

If developer particles have an average particle diameter of 7–15 μm, developer particles which have particle diameter of no less than 20 μm interrupt, i.e. prevent, the charging of another developer particle. Because another developer particle does not contact with elastic blade 42, developer particles which have particle diameters of up to 5 μm cannot be sufficiently triboelectrically charged.

If developer particles have an average particle diameter of up to 7 μm, the developer does not flow well and the developed image does not have sufficient copy density. If developer particles have an average particle diameter of no less than 15 μm, the developed image does not have a high resolution.

The developer contains one of an inorganic oxide, inorganic salt and organic particle, such as colloidal silica, alumina, titanium dioxide, strontium titanate, barium titanate and polymethyl methacrylate so that the developer flows well and has a uniform charge.

EXAMPLE 1

A mixture comprising 87 parts of styren-n butyl methacrylate copolymer (Tg:62° C., weight average molecular weight 174000, number of average molecular weight 8700), 5 parts of carbon blade (Trade name: MA-600, manufactured by Mitsubishi Kasei), 3 parts of wax (Trade name: 660P, manufactured by Sanyou Kasei), charge controlling agent (Trade name: SAM-955, manufactured by Sanyou Kasai) was well blended in a blender for about 30 minutes. Then, the mixture was well kneaded by kneader for about 1 hour. The kneaded product was left to cool, crushed by a hammer mill and pulverized by a jet mill. It was then classified by a pneumatic classifier to obtain fine developer with particle diameter 7–15 μm.

Then, a mixture comprising 100 parts of this developer, 0.5 parts of colloidal particle which had large particles removed (Tradename: Rp-130, manufactured by Nihonaerojiru) was well mixed on a ball mill, so that colloidal particles adhered to surface of the developer particles. The developers were sieved using a 250 mesh sieve to remove large particles. A non-magnetic one-component developer which had a 50% weight average particle diameter of 12.1 μm and a positive charging property was obtained. The developer had frictional charge of 49.4 $\mu c/m^2$.

The developer was tested on a commercially available plain paper copier (Trade name: BD-3110, manufactured by Toshiba) which was remodeled into copier using an OPC photosensitive. The thus obtained copied image was good image without fog. When the environmental conditions were changed to 30° C. and 85% R.H. (the developer was unchanged from that under normal conditions) a clear image could be obtained without fog. Particle diameter of developer was defined by measurement with a counter (Trade name: COULTER COUNTER MODEL TAII, manufactured by Coulter Electronics).

EXAMPLE 2

A developer was prepared in accordance with the procedure as described in the foregoing EXAMPLE 1, except that conditions of classification and crush were changed. The developer was made from same component materials as described above in EXAMPLE 1. The developer had an average particle diameter of about 13.9. μm.

EXAMPLE 3

A developer was prepared in accordance with the procedure as described in the foregoing EXAMPLE 1, except that conditions of classification and crush were changed. The developer was made from same component materials as described in the above EXAMPLE 1. The developer had an average particle diameter of about 10.4 μm.

EXAMPLE 4

A mixture comprising 90 parts of styren-n butyl methacrylate copolymer (Tg: 62° C., weight average molecular weight 174000, number of average molecular weight 8700), 5 parts of carbon black (Trade name: MA-100: manufactured by Mitsubishi Kasei), 3 parts of wax (Trade name: 660P, manufactured by Sanyou Kasei), 2 parts of charge controlling agent (Trade Name: T-2, manufactured by Nihon Kagaku) was well blended in a blender for about 30 minutes. Then, the mixture was well kneaded by kneader for about 1 hour. The kneaded product was left to cool, crushed by a hammer mill and pulverized by a jet mill. It was classified by a pneumatic classifier to obtain fine developer with particle diameter of 7–15 μm.

Then, a mixture comprising 100 parts of this developer, 0.5 parts of colloidal particle having large particles removed (Trade name: R-972, manufactured by Nihonearojiru) was well mixed on a ball mill, so that colloidal particles adhered to surfaces of developer particles. The developer was sieved by a 250 mesh sieve to remove large particles. A non-magnetic one-component developer which had a 50% weight average particle diameter of 12.3 μm and a negative charging property was obtained. The developer had frictional charge of −32.5 $\mu c/m^2$. The developer was tested by a commercially available plain paper copier (Trade name: BD-3110, manufactured by Toshiba) which was remodeled into copier using an OPC photosensitive of positive charge. The thus obtained copied image was good image, and image could be obtained without fog, when the environment conditions were same conditions as EXAMPLE 1.

Particle diameter of developer was defined by measurement with a counter (Trade name: COULTER COUNTER MODEL TAII, manufactured by Coulter Electronics).

EXAMPLE 5

A developer was prepared in accordance with the procedure as described in the foregoing EXAMPLE 1, except that conditions of classification and crush were changed. The developer was made from same component materials as described above in EXAMPLE 4. The developer had an average particle diameter of about 14.5 μm.

EXAMPLE 6

A developer was prepared in accordance with the procedure as described in the foregoing EXAMPLE 1, except that conditions of classification and crush were changed. The developer was made from same component materials as described in the above EXAMPLE 4. The developer had an average particle diameter of about 11.3 μm.

COMPARATIVE EXAMPLE 1

A developer was prepared in accordance with the procedure as described in the foregoing EXAMPLE 1, except that conditions of classification and crush were changed. The developer was made from same component materials as described in the above EXAMPLE 1. The developer had particle diameter wherein the developer particles of up to 5 μm constituted at least 25% of the particle number distribution and the developer particles of no less than 20 μm in particle diameter contained in the developer constituted at least 5% of the particle size volume distribution.

COMPARATIVE EXAMPLE 2

A developer was made from the same component materials as described in the above EXAMPLE 1. The developer was prepared in accordance with the procedure as described in the foregoing EXAMPLE 1, except that the developer was sieved to remove large particles. The developer included colloidal particles wherein colloidal particles of no less than 10 μm contained in the developer constituted at least 20% of the particle size volume distribution.

COMPARATIVE EXAMPLE 3

The developer contained organic particles (poly methacrylate). The organic particles had the particle diameter of at least 10 μm which constituted at least 20% in the particle size distribution. The copied image was obtained by same plain paper as Example 1.

COMPARATIVE EXAMPLE 4

A developer was prepared in accordance with the procedure as described in the foregoing EXAMPLE 4 except that conditions of classification and crush were changed. The developer was made from same component material as described in the above EXAMPLE 4. The developer had a 50% weight average particle diameter of up to 7 μm.

COMPARATIVE EXAMPLE 5

A developer was prepared in accordance with the procedure as described in the foregoing EXAMPLE 4, except that conditions of classification and crush were changed. The developer was made from same component materials as described in the above EXAMPLE 4. The developer had a 50% weight average particle diameter of more than 15 μm.

The various examples are summarized on the following.

| | | particle diameter distribution | | | |
|---|---|---|---|---|---|
| | polarity | 50% an average particle diameter (um) | at least 20 um the poriticle size volume distribution (%) | at most 5 um the particle number distribution (%) | |
| EXAMPLE 1 | + | 12.1 | 0.1 | 6.2 | colloidal silica |
| EXAMPLE 2 | + | 13.9 | 4.5 | 11.0 | colloidal silica |
| EXAMPLE 3 | + | 10.4 | 0.4 | 12.5 | colloidal silica |
| COMPARATIVE EXAMPLE 1 | + | 12.3 | 5.2 | 26.8 | colloidal silica |
| COMPARATIVE EXAMPLE 2 | + | 12.1 | 0.4 | 10.4 | colloidal silica |
| COMPARATIVE EXAMPLE 3 | + | 13.1 | 0.5 | 7.1 | poly-methyl methacrylate |
| EXAMPLE 4 | − | 12.3 | 0.1 | 7.9 | colloidal silica |
| EXAMPLE 5 | − | 14.5 | 4.0 | 12.2 | colloidal silica |
| EXAMPLE 6 | − | 11.3 | 1.6 | 9.3 | colloidal silica |
| COMPARATIVE | − | 6.7 | 0.0 | 62.4 | colloidal silica |

-continued

| | | | | | |
|---|---|---|---|---|---|
| EXAMPLE 4 | | | | | |
| COMPARATIVE EXAMPLE 5 | – | 15.6 | 8.7 | 6.8 | colloidal silica |

| | remove large particle | ELECTRIC CHARGE (uc/m$^2$) | IMAGE DENSITY | FOG (%) | |
|---|---|---|---|---|---|
| EXAMPLE 1 | ∘ | 49.4 | 1.38 | 0.5 | |
| EXAMPLE 2 | ∘ | 47.6 | 1.40 | 0.5 | |
| EXAMPLE 3 | ∘ | 71.2 | 1.34 | 0.2 | |
| COMPARATIVE EXAMPLE 1 | ∘ | 51.2 | 1.01 | 3.2 | image spotted |
| COMPARATIVE EXAMPLE 2 | x | 47.4 | 1.34 | 1.4 | |
| COMPARATIVE EXAMPLE 3 | x | 86.4 | 1.17 | 0.9 | white spot in block image |
| EXAMPLE 4 | ∘ | −32.5 | 1.36 | 0.3 | |
| EXAMPLE 5 | ∘ | −33.0 | 1.35 | 0.7 | |
| EXAMPLE 6 | ∘ | −37.8 | 1.35 | 0.4 | |
| COMPARATIVE EXAMPLE 4 | ∘ | −36.4 | 1.12 | 0.2 | |
| COMPARATIVE EXAMPLE 5 | x | −32.3 | 1.40 | 2.1 | white spot in block image |

While this invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A method for developing an electrostatic latent image, said method comprising the steps of:

a first forming step including forming an electrostatic latent image on a surface of a photosensitive member at a predetermined potential;

a second forming step including forming a thin layer of one-component developer particles on a developing member, which supplies one-component developer to said photosensitive member, by a supplying member contacting with said developing member;

triboelectrically charging said one-component developer to a charge in the range of |30 to 80| $\mu$/m$^2$, said one-component developer having particles that have an average particle diameter about 7–15 $\mu$m, developer particles up to about 5 $\mu$m diameter constituting at most about 25% in a particle number distribution and developer particles of at least 20 $\mu$m diameter constituting at most about 5% of a particle size volume distribution, said charging step including pressing a blade member toward a surface of said developing member at a pressure in the range of from about 20 to 500 g/cm, said pressing step including using the blade member with particles disposed thereon, the particles on said blade having a melting temperature of at least 80° C. and an average particle diameter of about 50% of the particles being about 10 $\mu$m at most; and applying a superimposed voltage including an AC voltage of at least 1.0 kV at a frequency of at least 1 kHz and a predetermined DC voltage to said one component developer particles on said developing member so as to supply said one-component developer particles from said developing member to said photosensitive member to develop said electrostatic latent image thereon.

2. A developing method according to claim 1, further comprising the step of adding second particles to said developer, said second particles include at least one element selected from the group consisting of colloidal silica, alumina, titanium dioxide, strontium titanate, barium titanate, and poly-methyl methacylate.

3. A developing method according to claim 1, further comprising locating said photosensitive member about 25 $\mu$m from said developing member.

4. A developing method according to claim 3, wherein said AC voltage is about 2.0 kV at a frequency of about 3 kHz and said DC voltage is about 200 V.

5. A developing method according to claim 4, wherein said first forming step includes negatively charging said photosensitive member to a surface potential of about 600 V.

* * * * *